US006851675B1

(12) United States Patent
Jakubec et al.

(10) Patent No.: US 6,851,675 B1
(45) Date of Patent: Feb. 8, 2005

(54) LAUNCHING GAME APPARATUS AND METHOD

(76) Inventors: James A. Jakubec, P.O. Box 99, Oak Grove, AR (US) 72660-0090; Edward Jakubec, P.O. Box 99, Oak Grove, AR (US) 72660-0090

( * ) Notice: Subject to any disclaimer, the term of this patent is extended or adjusted under 35 U.S.C. 154(b) by 0 days.

(21) Appl. No.: 10/281,060

(22) Filed: Oct. 24, 2002

Related U.S. Application Data

(60) Provisional application No. 60/352,009, filed on Oct. 24, 2001.

(51) Int. Cl.[7] ..... A63F 9/02
(52) U.S. Cl. ..... 273/355; 273/357
(58) Field of Search ..... 273/355–357, 273/349, 398–402, 407

(56) References Cited

U.S. PATENT DOCUMENTS

| | | | | | |
|---|---|---|---|---|---|
| 3,802,705 | A | * | 4/1974 | Burns et al. | 273/357 |
| 4,240,396 | A | | 12/1980 | Randoll | 124/17 |
| 4,243,220 | A | | 1/1981 | Shelley | 273/1 |
| 4,684,137 | A | | 8/1987 | Armer, Jr. et al. | 273/428 |
| 4,909,518 | A | | 3/1990 | Erlandson et al. | 273/357 |
| 5,249,564 | A | * | 10/1993 | Peachey | 124/17 |
| 5,823,849 | A | * | 10/1998 | Gardner et al. | 446/473 |
| 5,833,234 | A | * | 11/1998 | Vavala et al. | 473/434 |
| 5,947,476 | A | * | 9/1999 | Rousay | 273/384 |
| 5,967,523 | A | * | 10/1999 | Brownlee | 273/407 |
| 6,083,124 | A | * | 7/2000 | Williams | 473/421 |
| 6,182,609 | B1 | * | 2/2001 | Sparkman | 119/427 |
| 6,543,776 | B2 | * | 4/2003 | Macaluso | 273/400 |
| 6,546,923 | B2 | * | 4/2003 | Erickson | 124/16 |
| 2001/0034271 | A1 | * | 10/2001 | Nozato | 473/197 |

* cited by examiner

*Primary Examiner*—Mark S. Graham
(74) *Attorney, Agent, or Firm*—Keisling Pieper & Scott PLC; Trent C. Keisling; David B. Pieper

(57) ABSTRACT

A tossing game apparatus and method is provided utilizing a compactable shield launching device, including a base, a shield support pivotally mounted to the base, with a shield positioned on the shield support. A launching device may be supported independently or off of the shield support to create a solid or compactable launching device which is selectively positionable in both an extended position and a flat compacted travel position. A filling station is also described which is either solid or movable between an extended filling position and a reduced volume travel position. Further embodiments describe an apparatus and method for constructing a balloon tying station off of a water hose faucet utilizing at least two spaced support surfaces defining a central tying opening, tube, half pipe, or tying device.

4 Claims, 9 Drawing Sheets

LAUNCHING GAME APPARATUS AND METHOD

CROSS-REFERENCE TO RELATED APPLICATIONS

This application hereby claims priority as a continuation-in-part of U.S. provisional application Ser. No. 60/352,009, filed on Oct. 24, 2001, which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of launching or tossing games in general. In particular, the present invention relates to a slingshot-based object tossing game utilizing burstable and nonburstable objects. Known art may be found in U.S. classification 237, subclass 357 with other related items found in subclasses 1 R and 428; and additional material on slingshot type launchers may be found in U.S. classification 124, subclass 17 as well as in other classes and subclasses.

2. Description of the Known Art

As will be appreciated by those skilled in the art, a slingshot may be used to launch a water balloon, snowball, or other object toward a target. Details of a typical water balloon launching apparatus are contained in U.S. Pat. No. 4,909,518 issued to Erlandson et al. on Mar. 20, 1990.

Examples of slingshots may be found in U.S. Pat. No. 4,240,396 issued to Randoll on Dec. 23, 1980, and other game devices may be found in U.S. Pat. No. 4,243,220 issued to Shelley on Jan. 6, 1981; and U.S. Pat. No. 4,684,137 issued to Armer, Jr. et al. on Aug. 4, 1987. Each of these patents is hereby expressly incorporated by reference in their entirety.

U.S. Pat. No. 4,909,518 issued to Erlandson et al. on Mar. 20, 1990 describes a water balloon game. This patent describes a game participant enclosure for a water balloon game including a plurality of side walls and an overhead protector. The protector includes a water balloon opening sufficiently large for the user standing inside the enclosure to launch a water balloon through the enclosure. A water balloon launcher is disposed inside the enclosure for this purpose.

U.S. Pat. No. 4,240,396 issued to Randoll on Dec. 23, 1980 discloses a game-balloon launcher. This patent is directed to a device in the form of a slingshot utilizing a funnel as a holder for a balloon to be launched.

Thus, it may be seen that these prior art patents are very limited in their teaching and utilization, and an improved game apparatus is needed to overcome these limitations. What is needed then is a launching game apparatus and method for providing an improved game apparatus unit that is smaller and/or compactable and transportable for playing a launching game.

BRIEF SUMMARY OF THE INVENTION

The present invention is directed to an easily transportable improved launching game apparatus including both a shield station and a filling station which may be compactable. In accordance with one exemplary embodiment of the present invention, a tossing game apparatus is provided for which includes at least one shield launching device and at least one filling station.

Advantages of the present invention include a light weight transportable shield apparatus; a compactable shield apparatus; an innovative launching device; an innovative balloon tying station; an innovative water balloon filling station; and other improvements in these apparatus as noted herein. In one exemplary embodiment, the present invention includes a shield launching device including a base, a shield support mounted to the base, and a shield mounted on the shield support. The shield may be made compactable by utilizing pivoting connections between the shield and the base. In this manner, the shield support is operable to selectively position the shield in either an extended position or a flat compacted travel position for transportation of the compactable shield launching device. Further improvements include the addition of a launching device supported outside and in front of the shield support to allow for launching of an object while maintaining a substantial protection of the shield. Finally, the utilization of a filling station is described. The filling station can either be attached to a shield or launching device, attached to an existing water supply coupling, or provided as a separate unit of alternatively solid construction or compactable construction that is movable between an extended filling position and reduced volume travel position.

These and other objects and advantages of the present invention along with features of novelty apparent thereto, will appear or become apparent by reviewing the following detailed description of the invention.

BRIEF DESCRIPTION OF THE SEVERAL VIEWS OF THE DRAWING

In the following drawings, which for a part of the specification and which are to be construed in conjunction therewith, and in which like reference numerals have been employed throughout wherever possible to indicate like parts in the various views.

DETAILED DESCRIPTION OF THE INVENTION

Figure 1:
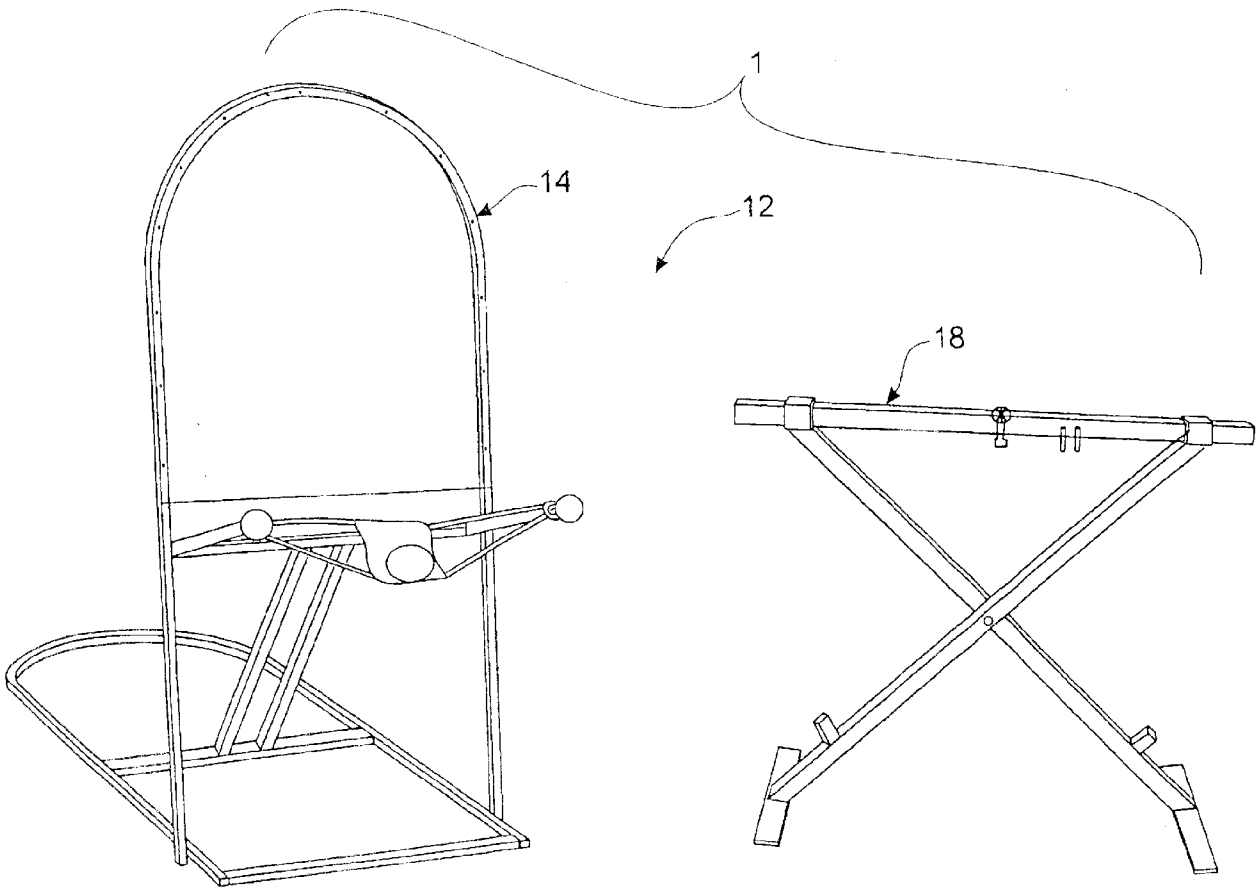
FIG. 1 is a perspective view in an exemplary embodiment of one game set embodiment of the present invention.
Figure 2:
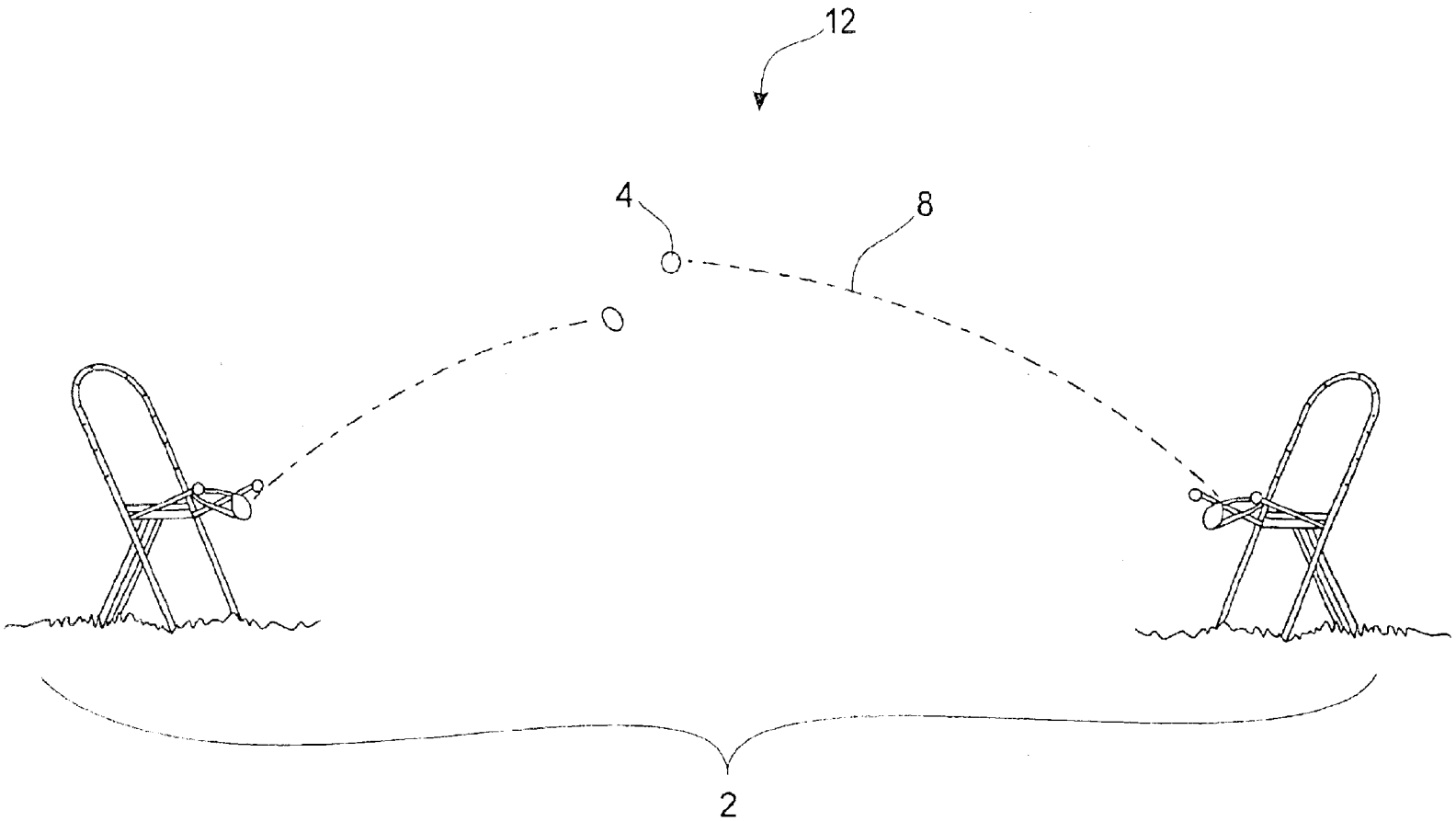
FIG. 2 is a perspective view of opposing launching stations utilized in the game type set up.
Figure 9:
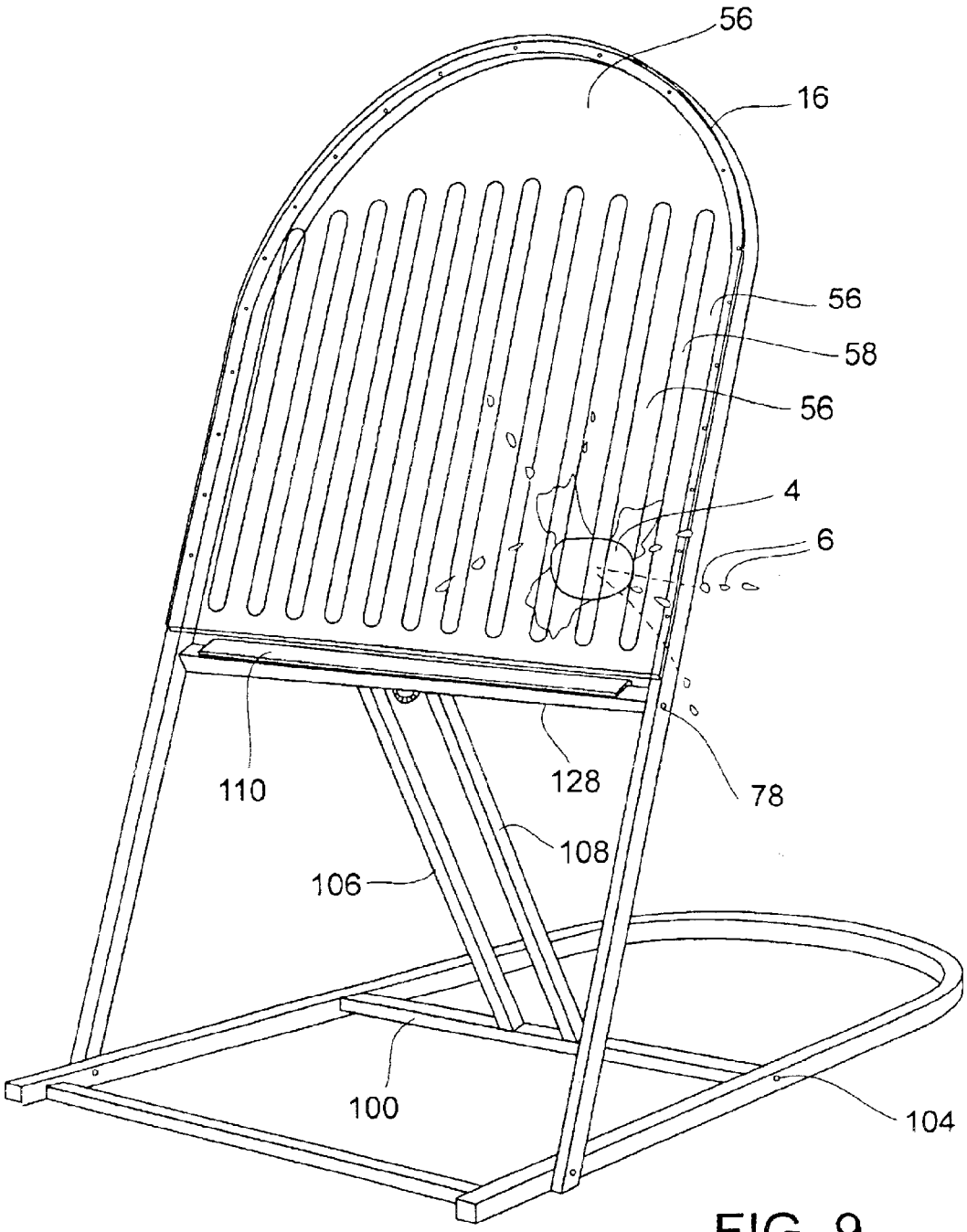
FIG. 9 is a perspective view of a compactable shield apparatus.

As shown in FIG. 1 of the drawings, one exemplary embodiment of the present invention is generally shown as an all season game set 1 for the tossing game shown in FIG. 2. The use of this game set may be understood by referencing FIG. 2 of the drawings which shows an active view of a tossing game 2 utilizing a safe projectile flying object 4 also known as a water balloon 4, snowball 4, a sponge 4, a foam ball 4, blob of gelatin or JELL-O™ 4, wadded clothing 4, confetti 4, or a burstable sack 4. Either wet or dry objects 4 may be utilized. When utilized, wet flying objects 4 are designed to break apart or transform at impact such that a pass through portion, such as water droplets, of the object 6 as shown in FIG. 9 may be utilized to enhance the tossing game 2 experience. As shown in FIG. 2, the flying object 4 is launched from an object launching station 14 in a trajectory 8 to impact against a target, opposing player, or the shield of the opposing player. Target examples include hula hoops, spinning targets, trees, bushes, or any other safe target.

The game set 1 shown in FIG. 1 of the drawings is part of a water balloon game apparatus 12 that may have many configurations including one configuration having at least a launching apparatus 14, also known as an object launching station 14, and an object filling station 18 also known as a water balloon filling station or an object filling station 18. An alternative or additional item for the water balloon game apparatus 12 includes the shield apparatus 16, also known as an object shield station 16, which is shown in FIG. 9. Other alternative configurations include multiple launching apparatus 14 as shown in FIG. 2. These examples are illustrative only and are not meant to limit the number of configurations for the game apparatus 12.

Figure 3:
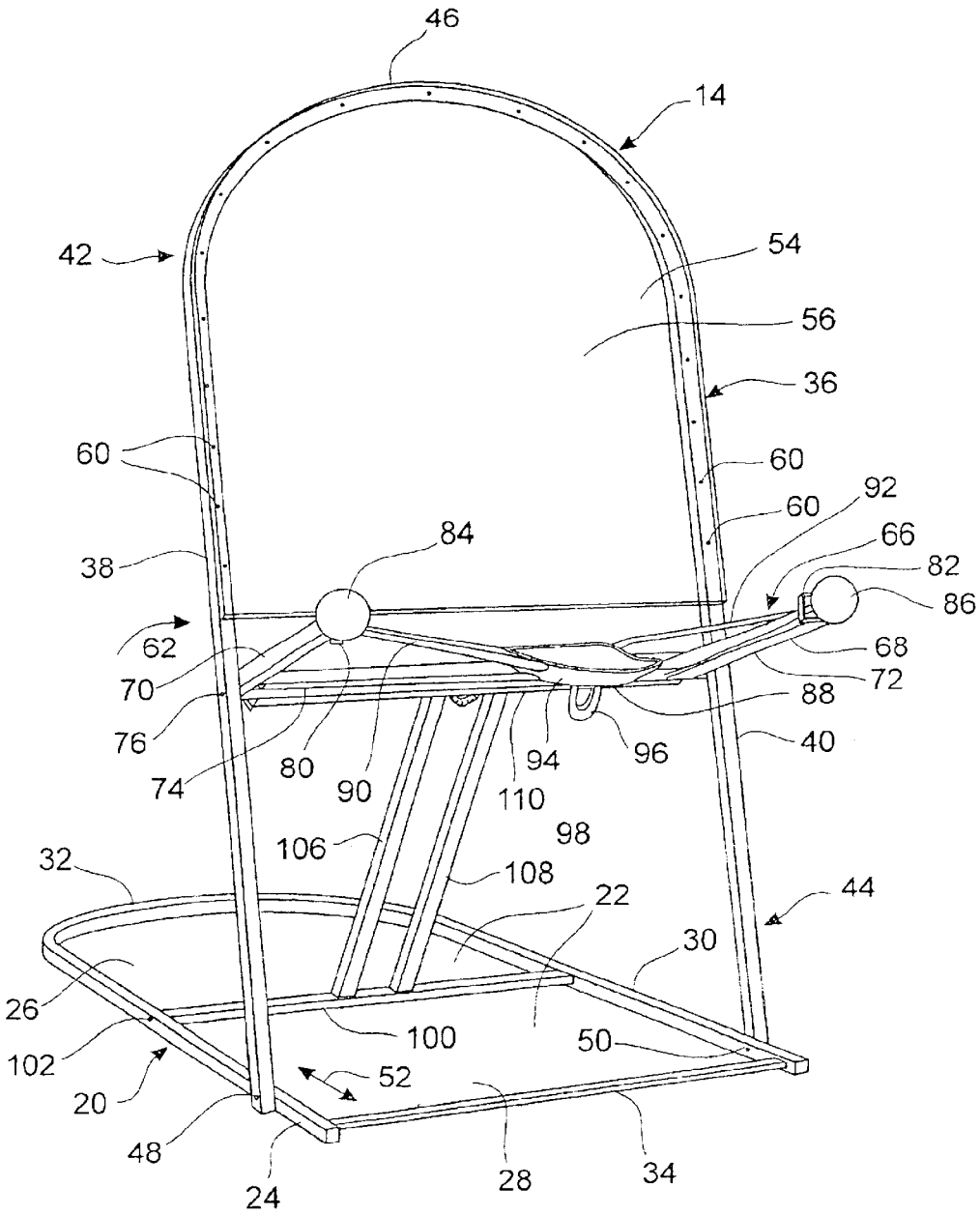
FIG. 3 is a perspective view of the object launching station of the present invention.
Figure 4A:
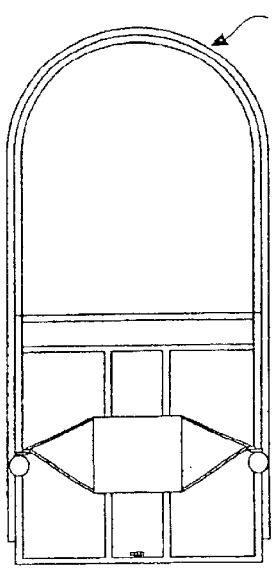
FIG. 4 is an exploded view of the various components of the object launching station of the present invention.
Figure 4B:
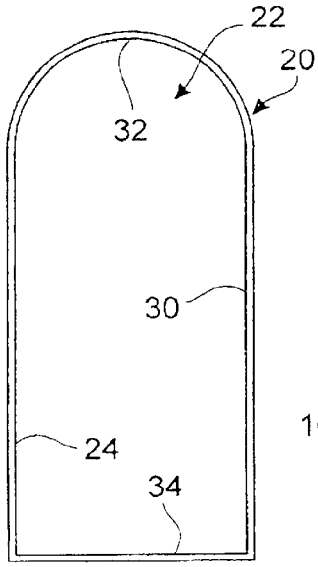
Figure 4C:
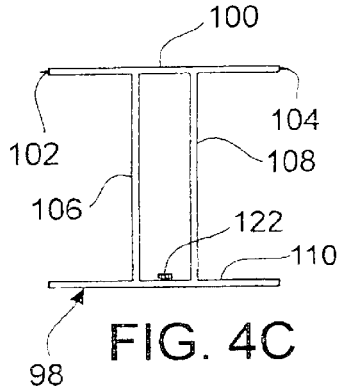
Figure 4D:
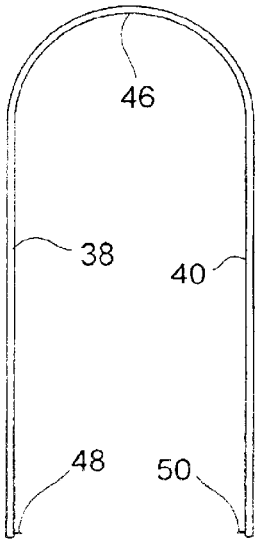
Figure 4E:
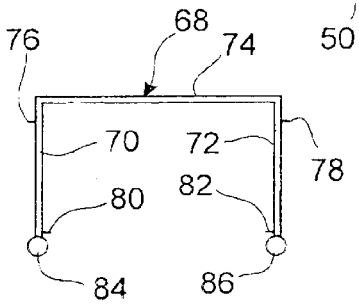
Figure 4G:
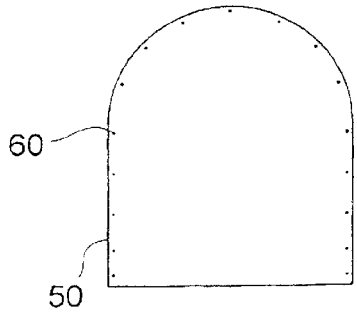
Figure 4F:
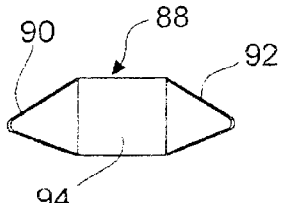

FIGS. 1–8 show the launching apparatus 14 also known as an object launching station 14. This launching apparatus 14 is preferably built as a lightweight transportable apparatus constructed as a solid unit, a separable and connectable unit, or a unitary collapsible unit. The preferred embodiment is the collapsible unit as described herein. As shown in FIG. 3, the launching apparatus 14 includes a base 20 defining a base area 22 as the interior of a first base rail 24, a second base rail 30, a base head cross bar 32, and a base cross bar 34. The base may include a base seat (not shown) or use an item such as a milk crate, stool, or other item as a seating area for larger players. Players may also stand or kneel in the unit for operation. The cross bar 34 is not necessary and the threaded bolt locking mechanism 122, described further infra, utilizing the cross bar could be replaced by any type of stop or buttons using a friction, magnet, snap, clasp, or strap type of connection in lieu of the threaded bolt described herein. The base area 22 has a head end 26 and a foot end 28.

The shield support 36 is pivotally supported by the base 20 at any angle appropriate to protect the user. The shield support 36 utilizes a first shield rail 38 and a second shield rail 40 connected to a shield head cross bar 46 at the head end 42 of the shield support 36. The foot end 44 of the shield support 36 includes a first shield-base pivot 48 connecting the first shield rail 38 to the first base rail 24. The foot end 44 of the shield support 36 also includes a second shield-base pivot 50 connecting the second shield rail 40 to the second base rail 30. The shield-base pivots 48 and 50 are connected at a distal position 52 from the base cross bar 34 such that the base extends beyond the shield support 36 to provide additional stability when the shield support 36 is extended upward into the shield position as shown in FIG. 3.

In the preferred embodiment, the shield 54 is supported by the shield support 36 off of the base 20. Alternatively, the shield 54 can be disjointed and made as a free standing device, supported by independent supports, or supported by the center brace support 98. The shield 54 is also known as a translucent or opaque plate 54 which may be used to deflect burst, of change the path of the object 4 to protect the player from a direct hit. Other shield 54 constructions may use holes, slots, screen, mesh, chain link, wire, or other openings in the shield that allow for slowing, ricochet or deflection of the object 4 or part of its contents. The shield 54 includes an impact area 56 and may or may not include protection grid apertures 58 as shown in FIG. 9. Shield connectors 60 are utilized to connect the shield 54 to the shield support 36. The preferred shield connectors 60 may include bolts, screws, adhesive, or pop rivets. When the shield support 36 pivots upward to extend the shield 54 into a raised position from the base 20, the shield is placed in an extended shield position 62 as indicated in FIG. 3 of the drawings. FIGS. 4 and 8 of the drawings show how the shield support 36 may be moved between the extended shield position 62 and a compacted travel position 64. This allows for the launching apparatus 14 to be easily transported between game playing locations.

The launching apparatus 14 also includes a launch device 66 which utilizes a launch support 68 and a slingshot 88. The launch support 66 may be manufactured to be independent of the shield 54 or the shield support 36 with an alternative type of free standing support, ground support, or even using other players for the support as shown in the prior art. However, the preferred embodiment places the launch support 66 for positioning the slingshot 88 in front of the shield. Additionally, the launch support 66 may be manufactured as a fixed position item or a separable or compactable construction. The preferred embodiment for the launch support 66 uses a compactable construction as described herein. The launch support 68 includes a first extension arm 70 and second extension arm 72 connected by an arm cross bar 74. The first extension arm 70 is connected by the first arm support pivot 76 to the first shield rail 38. The second extension arm 72 is connected by the second arm-support pivot 78 to the second shield rail 40. In this manner, the launch support 68 may be rotated between an extended and a contracted position in association with the extension and contraction of the shield 56 to provide either an extended launch platform or a compacted and easy to transport arrangement as shown in FIG. 8. The slingshot 88 may be connected through any known means, but for the preferred embodiment, it is connected through the use of a first band capturing loop 80 on the first extension arm 70 and a second band capturing loop 82 on the second extension arm 72. For game safety, the end of the first extension arm 70 is protected by a first end protection cushion 84 shown as a large foam ball, and the end of the second extension arm 72 is protected by a second end protection cushion 86. This protects from accidental impact between a user and the end of the arms 70, 72 as well as helping with recoil of the slingshot 88.

The slingshot 88 includes a first elastic band 90 which is looped through the first band capturing loop 80 and then passes over the first end protection cushion 84 to wrap around the first extension arm 70. The other end of the first elastic band 90 is connected to the support sack 94 as is well known in the art. A second elastic band 92 extends from the opposite side of the support sack to pass through the second band capturing loop 82 such that the end may be looped around the second end protection cushion such that it encases the second extension arm 72. Alternatively, a single loop of an elastic band, or single bands or other elastic structures may also be used in place of the multiple bands 90, 92 described. In this manner, the slingshot 88 is secured to the first extension arm 70 and the second extension arm 72. A user may then reach forward of the shield support 36 to engage the sack handle 96 in order to stretch the slingshot 88 and launch the flying object 4 forward. Other types of holders are envisioned for the support sack 94 including but not limited to funnels, cradles, netting, tubes, and the like.

The shield support 36 is locked in position by a central support 98. The central support may take on any number of configurations such as a hinged support, a removable support, a solid support, a multiple component support, and may have any number of connections including pins, bolts, hinges, threaded bolts, or any other method as commonly know by those skilled in the art. The shield support 36 may not need the central support if it is fixed or locked in position directly off of the base or if an alternative bracing is utilized.

The central support 98 includes a back bottom bar 100, a first back to base pivot 102, a second back to base pivot 104, a first angled central support 106, a second angled central support 108, and a channel clamp 10. The first and second back to base pivot 102 and 104 allow for the central support to be extended after the channel clamp has been released by pivotally raising it from the base in a manner similar to that previously discussed for the shield support 36.

FIG. 4 of the drawings shows and assembled view and the separate components of the launching apparatus 14 with each of the subcomponents as previously described. FIG. 4*a* shows the launching apparatus 14 in its flat compacted travel position 64. FIG. 4*b* shows the base 20, and FIG. 4*c* shows the central support 98. FIG. 4*d* shows the shield support, and FIG. 4*e* shows the launch support 68. Finally, FIG. 4*f* shows the slingshot.

Figure 5:
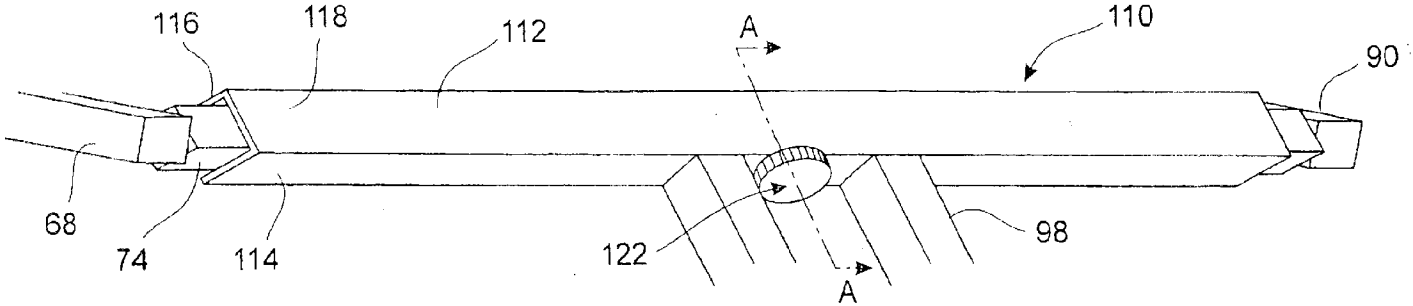
FIG. 5 is a perspective magnification of the U-shaped head bar of the central support as fixably engaging the arm cross bar of the launching device.
Figure 7:
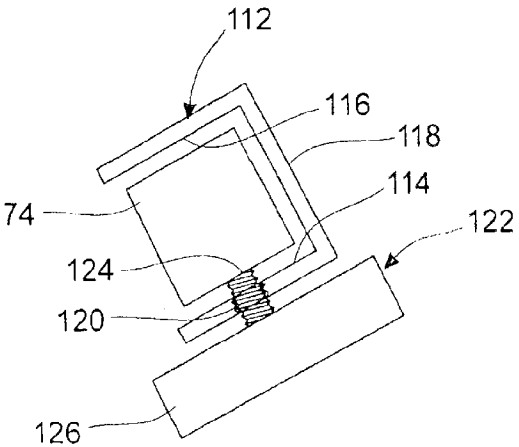
FIG. 7 is a cutaway view along line AA of FIG. 5.
Figure 6:
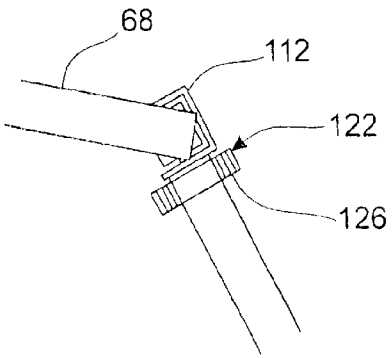
FIG. 6 is a side view of the magnification shown in FIG. 5.
Figure 8A:
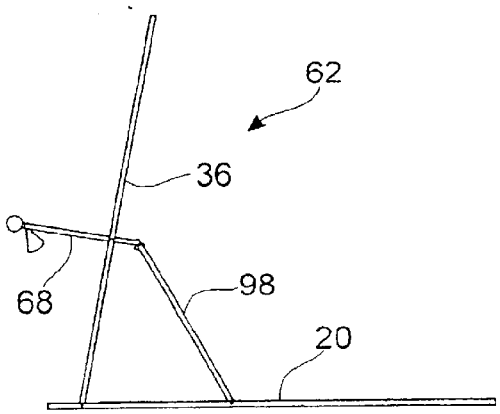
FIG. 8 is a series view of the movement actions for compacting the object launching station from an extended position into a compacted travel position.
Figure 8B:
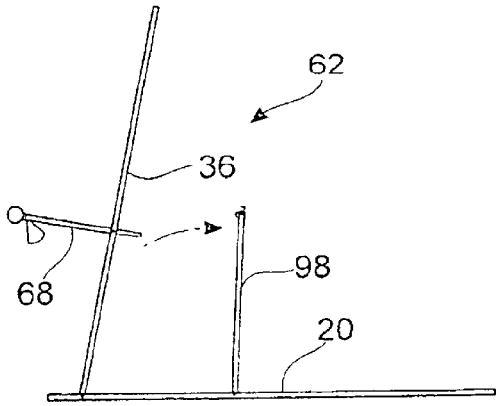
Figure 8C:
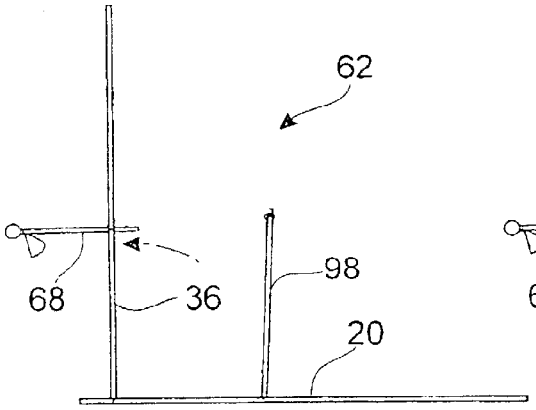
Figure 8D:
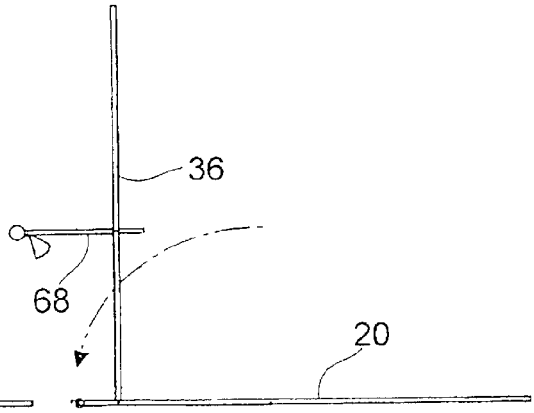
Figure 8E:
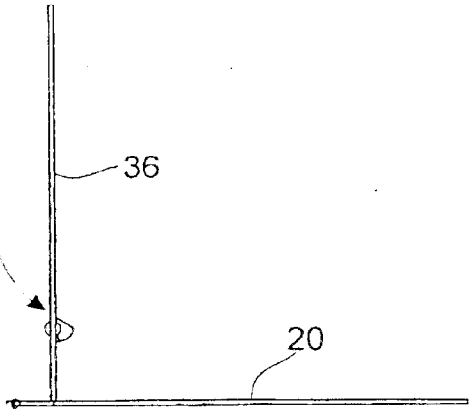
Figure 8F:
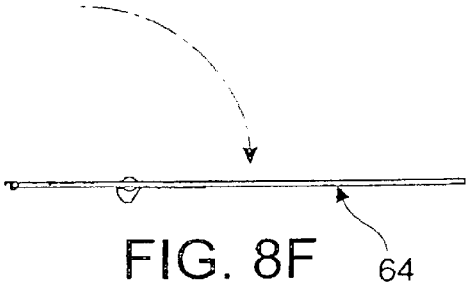

As shown in FIGS. 5 through 7 of the drawings, the channel clamp 110 of the central support 98 includes a U-shaped head bar 112 including a first side 114, a second side 116, and a top 118. The channel clamp is only meant to disclose the preferred embodiment, and should also be interpreted to include other connection methods including friction, locking pins, mating plates, dovetails, magnets, VELCRO™ or any other means to attach and secure items in position. The first side 114 of the U-shaped head bar 112 includes a threaded aperture 120 for engagement with a locking bolt 122. The locking bolt 122 includes a threaded extension 124 connected to a hand operable turning head 126. The hand operable turning head may be engaged by the user's hand in order to tighten and loosen the channel clamp 110 against the base cross bar 34 of the base in the compacted position to hold the central support 98 in a compacted position. The locking bolt 122 may also be loosened and then re-engaged against the arm cross bar 74 when the shield support 36 is in an extended position. As shown in FIG. 9 of the drawings, when a compactable shield apparatus 16 also known as an object shield station 16 is constructed utilizing a stationary support bar 128 in place of the launch device 66, the U-shaped head bar 112 may utilize the locking bolt 122 to engage the stationary support bar 128 to lock the shield support 36 in the extended position.

As shown in FIGS. 1–8 of the drawings, the launching apparatus 14 is similar to the compactable shield apparatus 16 shown in FIG. 9. The main difference between the launching apparatus 14 and the compactable shield apparatus 16 is the inclusion of the launching device 66 on the launching apparatus 14.

FIG. 8 of the drawings shows the compaction of the launching apparatus 14 from its extended shield position 62 into the compacted travel position 64. FIG. 8*a* shows the initial extended shield position 62. FIG. 8*b* shows how the central support 98 is then unlocked from the arm cross bar 74 and rotated counter clockwise from the launching support 68. FIG. 8*c* shows the movement of the shield support 36 rotation in a clockwise movement to provide clearance for the next rotation of the central support 98. As shown in FIG. 8*d*, the central support 98 is then rotated in a clockwise motion down into the base 20 and the channel clamp 110 is locked against the base cross bar 34 using the locking bolt 122. FIG. 8*e* shows how the launch support 68 is then rotated in a clockwise motion to the shield support 36 to compact the launch support 68 into the shield support 36. Finally, FIG. 8*f* shows how the shield support 36 is then rotated in a counter clockwise motion down onto the base 20 to achieve the flat compacted travel position 64.

FIG. 9 is a perspective view of a compactable shield apparatus showing the use of a stationary support bar 128 in place of the arm cross bar 74 of the launching device 66. This provides the appropriate connection for the channel clamp 110 of the central support 98. Additionally, FIG. 9 shows the use of an alternative shield design which utilizes an impact area 56 having protection grid apertures 58 so that particles 6, such as water droplets, of a burst object 4, such as a water balloon, may pass through the shield 56 to impact the player and enhance the game experience while still maintaining substantial shield 56 protection from the actual impact with the object 4.

Figure 10:
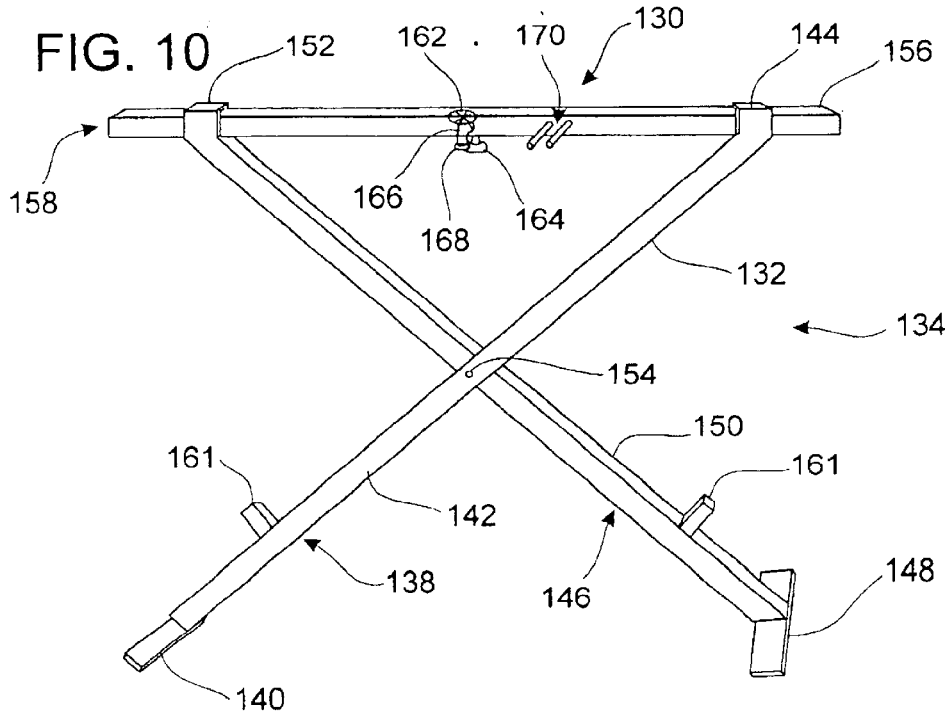
FIG. 10 is a perspective view of an object filling station.
Figure 11:
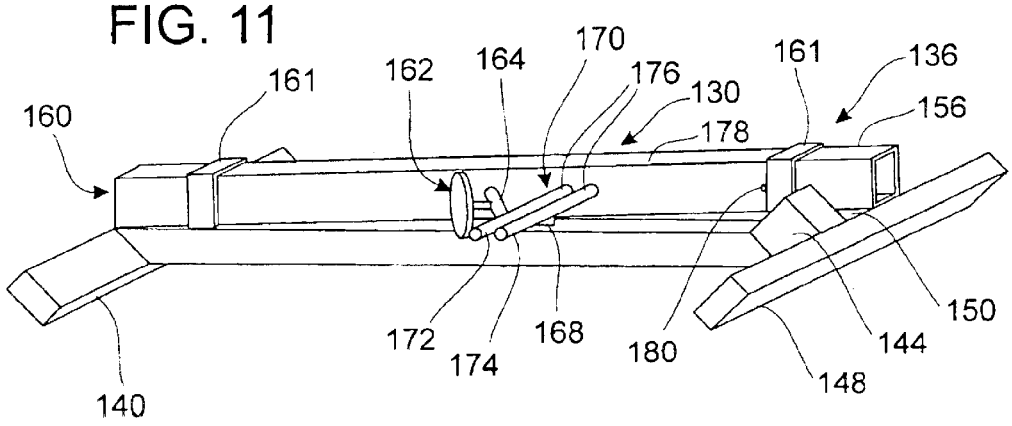
FIG. 11 is a compacted view of the filling station shown in FIG. 10.

FIGS. 1, 10 and 11 of the drawings show the ground stand 130. The ground stand 130 includes either a solid of a collapsible base 132 supporting a U-shaped fill bar 156. The fill bar 156 may also be used separate from the ground stand 130 or may also be incorporated into the launch stand 14. The preferred embodiment's collapsible base 132 is movable between a support position 134 and a travel position 136. Movement between these positions is enacted by the first ground support 138 which includes a first foot 140 attached to a first leg 142 connected through a leg pivot connection 154 which attaches to the second ground support 146 including a second foot 148 and a second leg 150. The first leg 142 includes a first bar support 144 and the second leg 150 includes a second bar support 152 which may be frictionally engaged by sliding the U-shaped fill bar 156 into the bar supports 144, 152 and then pivoting the legs 142, 150 to engage the supports 144, 152 against the fill bar 156 to hold it in position. In this manner the U-shaped fill bar 156 may be selectively removed from the ground stand for positioning. The U shaped fill bar 156 may be positioned in a raised position 158 when the ground stand is placed in its support position 134. Alternatively, the U-shaped fill bar 156 may be supported by the compacted holding loops 161 which are connected to the legs 142 and 150 of the ground stand 130. In this manner, the U-shaped fill bar 156 may be held in the compacted position 160 for transportation.

In one preferred embodiment, the U-shaped fill bar 156 supports a pivoting spigot 162 which includes a water supply coupling 164 also known as a female hose connector 164. The pivoting spigot may pivot ninety degrees up into the fill bar 156 to allow for protection of the valve threads. The pivoting spigot 162 may or may not include a control valve 166 leading to a water discharge port 168 for filling the water balloon 4 or other object 4. Placed next to the pivoting spigot 162 on the preferred embodiment of the U-shaped fill bar 156 is a tying assistance apparatus 170 also known as a balloon tying station 170. The fill bar 156 can use either just a nozzle, just a tying device, a combination of a nozzle and a tying device, or multiple nozzles and tying devices in combination. A stand alone stationary or high volume model may accommodate quite a few participants and be used completely independently for uses such water balloon tosses or water balloon fights where participants throw balloons at each other either in a field, forest, or man made maze or inflatable type arena. The nozzle may include any type of straight, funneled, or tapered spout including curved and angled spout design with smooth, ridged, or liped surfaces. The fill bar 156 may take on different shapes such as a square tube, or other type of round conduit made of any other type of material which could be made to hold water pressurized or not.

An alternative embodiment of a fill station may be used independently of piped in water such as that found in a municipal or well system. A basin, bucket, or other type tank or reservoir can be used to hold water which may be pumped with a mechanical pump powered by battery, electric, or human power, or a tank may be supported overhead and use gravity feed or siphon type pressure to feed the fill station 156.

The tying assistance apparatus 170 includes a first tying extension 172 and a second tying extension 174 having support surfaces 176 defining a central tying opening 178, tube, half pipe, or tying device 178. The tying assistance apparatus is placed next to the valve in the preferred embodiment so that it extends outwards to protect the valve nozzle. As is known in the area of balloon 4 tying, a simple half knot will suffice for tying a water balloon 4. To utilize the first and second tying extensions 172 and 174 for tying the balloon 4, the balloon 4 is placed across the top of the support surfaces 176 and wrapped around the tying extensions 172 and 174 such that the end may be passed back into the central tying opening 178 and pulled underneath the first wrap of the balloon 4 to form a half-hitch type of knot. The entire balloon 4 with the formed knot may then be slid off the ends of the tying extensions 172 and 174 and tightened to seal the object 4.

A further improvement to the U-shaped fill bar 156 is the utilization of a stop bead 180 which may be frictionally engaged with the compacted holding loops 161 to frictionally hold the U-shaped fill bar 156 in the ground stand 130 in both the raised position 158 and the compacted position 160.

Figure 12:
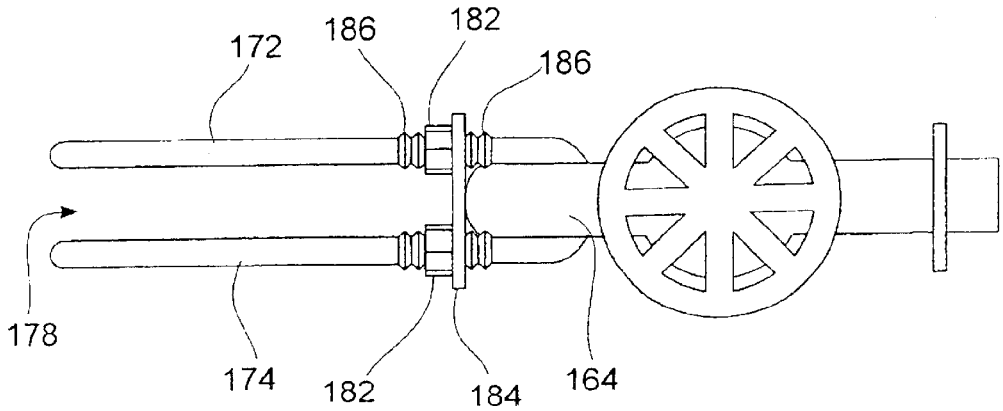
FIG. 12 is a top view of a balloon tying station incorporating a standard water faucet.
Figure 13:
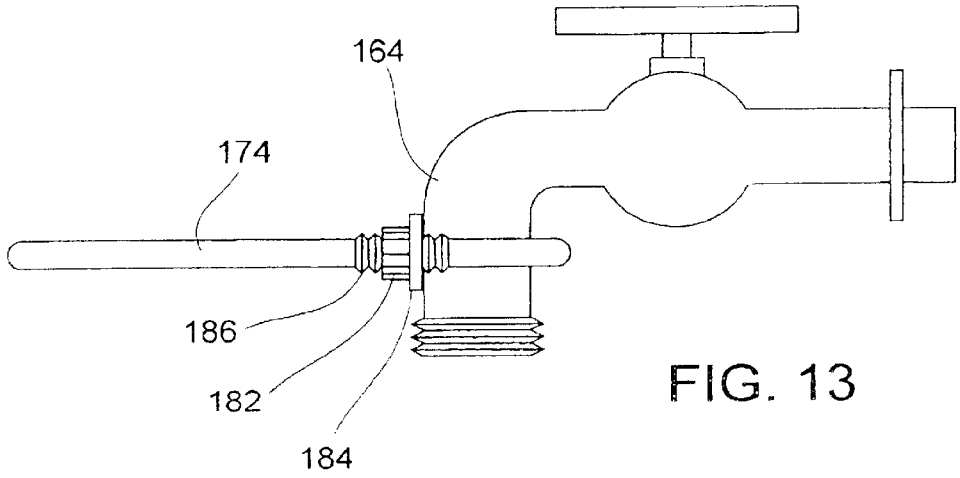
FIG. 13 is a side view of the balloon tying station shown in FIG. 12.

FIGS. 12 and 13 of the drawings show how the first tying extension 172 and the second tying extension 174 may be formed in a simple U-shape to be wrapped around a water hose supply coupling 164 that is usually found extending from the side of a home or business, water supply, hose, or conduit. In this manner, a tying assistance apparatus 170 may be constructed on any standard valve assembly by merely tightening nuts 182 against a cross bar 184 engaging threads 186 on alternative sides of a U-shaped member such that the ends of the U-shaped member form the first tying extension 172 and the second tying extension 174. The tying apparatus may be placed at any angle to the valve depending on the location of the valve and other safety considerations.

Note for FIGS. 12 & 13 that this is just one type of a myriad of styles and a complete separate fill and balloon tying device which is small and designed to mount on, to, or near any common water spigots found on homes or buildings which can be used off of a hose as well as mounted to any surface such as a table, chair, sawhorse, or any other structure which may or may not be in close proximity to play. This fill station can be mounted with any type of mounting hardware including the method described using a nut on a threaded rod. It could also be a molded self-contained plastic unit mounted only from the spigot's threaded hose port. A still further alternative may use any number of attaching devices such as clamps, spring clips, or just the weight of the fill station self supporting itself. Other constructions may embody just a tying device as shown in FIGS. 12 & 13 but should not be construed to be limited to just a tying device but may embody a filling nozzle as well the may be selected with or without a separate on off valve. An auxiliary or "Y" fitting may be used to allow independent use of a garden hose or access to the water from the building outside the unit either before or after the fill/tying unit.

The slingshot 88 in the present embodiment is pulled back and released by the player using human power and skill to aim. Although the invention should be interpreted to include all types of mechanical triggering devices including any number of mechanical stretching devices such as a hand crank, pulley system, a foot pedal stretcher, hydraulic or any other type device to stretch the elastic band. Also, any type triggering devise such as a pull pin, trigger, push off rod, pressures sensitive release device, and the like may be utilized. Furthermore, any and all types of aiming systems devices such as a turret or lazy susan, spindle, tiling arms or any other type of device used in conjunction with the operation of the slingshot on the launch station may also be combined with the present invention.

A separate type of sensing devise may also be used to note a hit when the station, shield, or target is hit with the projectile. It may trigger a sound alarm, a vibration, a light, a counter, a mechanical spray of water, or any other type of reaction due to the concussion of the projectile.

The construction may be on any type of material including wood, steel, aluminum, PVC, plastics, or any other type of material allowing for the design chosen to be the final form. Steel is used in the preferred embodiment for the framing members. Connections may be of any type including glue, bolts, nuts, screws, pins, push assemblies, snap assemblies or other appropriate constructions.

This unit may be used as a multiple season water device such as the replacement for any dunk tank or other type of water splashing game, which drenches soaks or submerges the player completely. Additionally, any part of this construction may be used as an integral part of the game or can be used separately or independently of the game. This shield unit also can be used by with any other projectile launched by human or mechanically launched, shot, or propelled projectiles independent of the actual launch station mentioned.

From the foregoing, it will be seen that this invention is well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matters herein set forth were shown in the accompanying drawings is to be interpreted as illustrative and not in a limiting sense.

What is claimed is:

1. A compactable shield apparatus of a tossing game using a flying object, the shield apparatus comprising:

a base defining a base area;

a shield support connected to the base;

a shield connected to the shield support and adapted to shield the base area from the flying object;

a launch device adapted to launch at least one flying object including a launch support mounted in front of the shield support; and, a slingshot connected to the launch support;

the launch support including a first extension arm moveably connected to the shield support; and, a second extension arm moveably connected to the shield support.

2. The apparatus of claim 1, the launch support further comprising:

an arm cross bar connected to the extension arms and adapted to support the extension arms.

3. A compactable shield apparatus of a tossing game using a flying object, the shield apparatus comprising:

a base defining a base area;

a shield support connected to the base;

a shield connected to the shield support and adapted to shield the base area from the flying object; and a launch device adapted to launch at least one flying object, the launch device including a launch support mounted in front of the shield support and a slingshot connected to the launch support; and at least one extension arm including an end protection cushion.

4. A compactable shield apparatus of a tossing game using a flying object, the shield apparatus comprising:

a base defining a base area;

a shield support connected to the base, the shield support movably attached to the base and adapted to position the shield in both an extended shield position and a compacted travel position;

a shield connected to the shield support and adapted to shield the base area from the flying object; and a central support movably connected to the base and the shield support, the central support adapted to support the shield support when the shield is in an extended position and further adapted to compact when the shield is in the travel position, the central support including a U-shaped head bar having a first side, a second side, and a top, the first side defining a threaded aperture; and, a hand operable locking bolt adapted to engage the threaded aperture and frictionally engage an item within the U-shaped head bar to lock the head bar to the item.

* * * * *